US006996153B2

(12) United States Patent
Brun et al.

(10) Patent No.: US 6,996,153 B2
(45) Date of Patent: Feb. 7, 2006

(54) CORE-TYPE FURNACE

(75) Inventors: Patrice Brun, Saint Michel d'Euzet (FR); Jacques Lacombe, Pujaut (FR); Christian Ladirat, Saint Laurent des Arbres (FR); Francis Bousquet, Goudargues (FR)

(73) Assignees: Commissariat a l'Energie Atomique, Paris (FR); Compagnie Generale des Matieres Nucleaires, Velizy Villacoublay (FR)

( * ) Notice: Subject to any disclaimer, the term of this patent is extended or adjusted under 35 U.S.C. 154(b) by 0 days.

(21) Appl. No.: 10/501,919

(22) PCT Filed: Jan. 31, 2003

(86) PCT No.: PCT/FR03/00299

§ 371 (c)(1),
(2), (4) Date: Jan. 24, 2005

(87) PCT Pub. No.: WO03/067166

PCT Pub. Date: Aug. 14, 2003

(65) Prior Publication Data

US 2005/0129087 A1 Jun. 16, 2005

(30) Foreign Application Priority Data

Feb. 4, 2002 (FR) ..... 02 01276

(51) Int. Cl.
*H05B 6/22* (2006.01)

(52) U.S. Cl. ..... 373/155; 373/156; 373/158

(58) Field of Classification Search ..... 373/7, 373/138, 151–156, 159–164; 75/10.14, 10.18; 219/543, 553

See application file for complete search history.

(56) References Cited

U.S. PATENT DOCUMENTS

| | | | | |
|---|---|---|---|---|
| 4,058,668 A | | 11/1977 | Clites | |
| 4,738,713 A | * | 4/1988 | Stickle et al. | 373/156 |
| 4,923,508 A | * | 5/1990 | Diehm et al. | 373/163 |
| 5,012,488 A | | 4/1991 | Stenzel | |
| 5,665,262 A | * | 9/1997 | Hajaligol et al. | 219/553 |

FOREIGN PATENT DOCUMENTS

| | | |
|---|---|---|
| EP | 0 398 821 | 11/1990 |
| EP | 0 538 024 | 4/1992 |
| GB | 2 333 147 | 7/1999 |
| JP | 05 322451 | 12/1993 |
| JP | 10 246578 | 9/1998 |

* cited by examiner

*Primary Examiner*—Tu Hoang

(74) *Attorney, Agent, or Firm*—Oblon, Spivak, McClelland, Maier & Neustadt, P.C.

(57) ABSTRACT

Vertical segments of a side wall of a crucible for an induction furnace are assembled at an adjustable, invariable position by screws screwed into tapped holes of a flange common to all segments. A precise assembly is thus obtained producing no deformation and no internal stresses. The segments are coated with a ceramic coating for their protection and to prevent formation of electric arcs. Junction edges of faces are rounded to achieve the same effect. Water cooling boxes of the lower furnace hearth are similarly constructed. The apparatus can, as an example, be applied to vitrification techniques.

7 Claims, 5 Drawing Sheets

CORE-TYPE FURNACE

BACKGROUND OF THE INVENTION

1. Field of the Invention

The subject matter of this invention is an induction furnace crucible and hearth for the incineration and vitrification of organic matter, the vitrification of radioactive and non-radioactive waste, the vitrification of hazardous waste and the fusing of refractory bodies.

2. Description of the Related Art

The structure of said furnaces essentially comprises a hearth in refractory concrete including cooling water circuits on which a side wall is arranged called the crucible, surrounded by an inductive coil in which an electric current circulates at frequencies higher than 100 kHz which is the source of the power produced inside the crucible to melt the matter therein. These furnaces are chiefly used for the incineration and vitrification of organic matter, the vitrification of radioactive or non-radioactive waste and the fusion of refractory bodies. The industries likely to have recourse thereto are waste treatment industries including nuclear and hazardous waste treatment, and the glass industry.

The side wall of the crucible is normally in metallic material permeable to magnetic fields. It contains a cooling circuit so that, firstly, the wall can resist the very high temperatures reached to melt refractory materials such as glass and, secondly, it can compensate for the electric power dissipated by the joule effect within the structure. Said crucible is called a "cold crucible". In addition it is normally divided into vertical segments, joined by their transverse faces by interposing an electric insulation material to limit currents induced in the wall which would cause heat losses and electromagnetic coupling between the inductor and the content of the crucible. The vertical segments are arranged similar to barrel staves. The cooling circuit usually consists of vertical channels bored in each of the segments.

The segments of the side wall of the crucible must be held together. One first means consists of surrounding the crucible with circular banding in cement or glass fabric impregnated with elastomer or epoxy resin. Another means, offering greater cohesion, consists of welding the segments to one another on a circular flange above the inductor where the intensity to magnetic fields is lower. A last type of assembly which is preferred for the invention consists of assembling the vertical segments and forming the ferrule by screws on a circular flange above the inductor. To facilitate assembly, the segments are provided with assembly lugs on the part mounted outside the ferrule.

The hearth supporting the ferrule is made up of metallic boxes through which a cooling circuit passes, the boxes being placed in refractory concrete, or consists of metallic tubing of various section (round, square, rectangular etc.) mounted in parallel or in chevrons and placed in refractory concrete. The boxes or tubes are separated from one another by a width of refractory concrete. One of the faces is positioned so as to lie perfectly opposite the content in fusion within the furnace. Similar to the tubing, the boxes may be of diverse shape: rectangular, triangular etc.

Known crucibles and hearths suffer from deficiencies which can be detailed as follows. For application to the combustion-vitrification of organic matter over molten glass baths, or the fusion of refractory bodies in an induction furnace, the frequencies and heats required are much higher than for other applications. Risks of electric short circuits may occur between the metallic elements forming the cold crucible (segments, flanges), forming the hearth supporting the crucible (cooled metallic boxes) and between the parts of the crucible and the hearth. These short circuits occur even when the electric insulation placed between the crucible segments and the hearth cooling boxes is of large width.

Without being exhaustive, these electric short circuits between the crucible segments and the hearth boxes are possible through the presence of carbon deposited on the inner walls during the combustion of organic matter, or through the formation of pools of sulphates on the surface of the glass baths entering into contact with different segments and the electric insulations in the inter-segments, or for example through the release of a large quantity of water at the time of fusion of refractory oxides. These short circuits cause irremediable damage to the electric insulations positioned between the parts forming the crucible, to the refractory concrete placed between the hearth cooling boxes, or can even pierce the metallic elements of the hearth and crucible. These electric short circuits are also harmful to efficient use of induction energy.

In the aforesaid applications, corrosive atmospheres at high temperatures are produced, which damage the metallic parts of the furnace consisting of the crucible and hearth, or require the same to be built in materials having high electric resistivity, considerably increasing electric losses.

Irrespective of the shape of the crucible segments (parallelepiped, T-shaped, triangular.) and of the hearth, the sharp edges of these adjacent metallic parts are the source of substantial electric arcs (electric spiking effect). Operating schedules are the chief contributors towards this onset of electric arcs, schedules demanding frequencies greater than 100 kHz for glass applications and waste treatment over molten glass baths. These electric arcs are energetic and harmful to the resistance of the electrical insulations of the crucible and hearth concrete. It is specified that if the crucible segments were round or ovoid, this would eliminate spiking effects but to the detriment of the imperviousness of the furnace ferrule by reducing too far the thickness of the electric insulation between the segments, which would lead to problems of matter and gas leakages as soon as the insulating material shows slight deterioration.

It is to overcome these disadvantages that a new type of crucible and hearth for an induction furnace is put forward as the invention.

SUMMARY OF THE INVENTION

To avoid the occurrence of electric arcs, the solution chosen consists of coating the metallic segments forming the crucible and metallic boxes of the hearth on one or all their faces with a ceramic electric insulation layer: at least on the inner and side surfaces of the segments facing one another to eliminate electric arcs or, depending upon chemical and electrical attack, on all the faces including the head, foot and surface facing the exterior of the furnace. These ceramic coatings are provided in addition to the electrical insulation placed between the segments of the crucible and the hearth boxes, and they provide perfect electric protection between the different metallic elements of the furnace and even between the metallic elements and the coating under fusion. In addition, thus coated, the segments of the crucible and the hearth boxes are protected against chemical attack due to glass, gases and other different waste fed into the crucible supported by the hearth. Refractory ceramic coatings, which are perfect electric insulators, are made by acetylene torch for example or plasma torch. The materials the most frequently sprayed contain alumina, mullite, cordierite, zircon, zirconia, silicon zirconate and carbide, with various dopants compatible with electric stresses.

Once coated on one or all their faces, the metallic boxes are placed in the hearth interposing an electric insulator such as refractory concrete. As for the crucible segments, once coated on one or all their faces with ceramic electric insulation, these may be mounted and screwed onto the cooled flange which may also be coated with electric insulation. In the description of the invention details will be given of the screw-mounting of the crucible which limits mechanical assembly stresses (local compressions) and heat stresses (if there are welds) but the invention can be fully applied to other types of assembly detailed in the prior art.

In the literature it is found that it is preferable to chamfer the sharp edges to avoid weakening of the ceramic coating and its flaking. While a chamfer on the sharp edges of the segments may help towards satisfactory depositing of the ceramic electric insulation on the segment faces, this is not at all sufficient to withstand the occurrence of electric arcs at frequencies above 100 kHz between the hearth boxes and the faces of those segments forming the inner part of the crucible, which for example lie opposite the carbon dust derived from the combustion of organic matter over the molten glass bath or opposite the elements to be vitrified.

The sharp edges oriented towards the inner surface of the furnace are rounded to a radius of curvature. The elimination of all sharp edges through radius of curvature machining concerns the sharp edges facing the inside of the induction furnace. The presence of chamfers on the other sharp edges outside the crucible may be sufficient without being obligatory. The size of these radii of curvature gives the following operating functions:

- the radius of curvature must not be small (less than 1 mm for example) to avoid any matter being trapped in the free air gap between the segments when the height of the glass bath varies,
- as in some configurations described in the prior art, an electric insulator such as mica may be maintained in the inter-segment space (mica thickness of between 0.1 or 4 mm) or the connection elements may be mounted with no additional electric insulation other than the ceramic deposit. The radius of curvature must be low (less than 5 mm) to ensure that the cooled metallic segments are sufficiently close to prevent the molten glass from coming into contact with the electric insulation placed in the spaces, which could deteriorate this insulation and allow matter to leak out from the crucible.

The invention sets itself apart in the specific cases concerning the incineration and vitrification of organic matter, the vitrification of waste and the fusion of refractory bodies, through its low heat flow exchange rates between the matter to be vitrified and the furnace walls. By way of example, these flow rates are lower by one order of magnitude than in cold crucibles for metal fusion through the self-generation, against the furnace wall, of a shell of glass that is solid and refractory. Under these conditions, the ceramic materials for electric protection are perfectly cooled preventing their deterioration, their flaking and above all preventing pollution of the vitrified matter.

BRIEF DESCRIPTION OF THE DRAWINGS

The invention will now be described in more detail and under every aspect in connection with the figures.

DETAILED DESCRIPTION OF THE INVENTION

Figure 1:
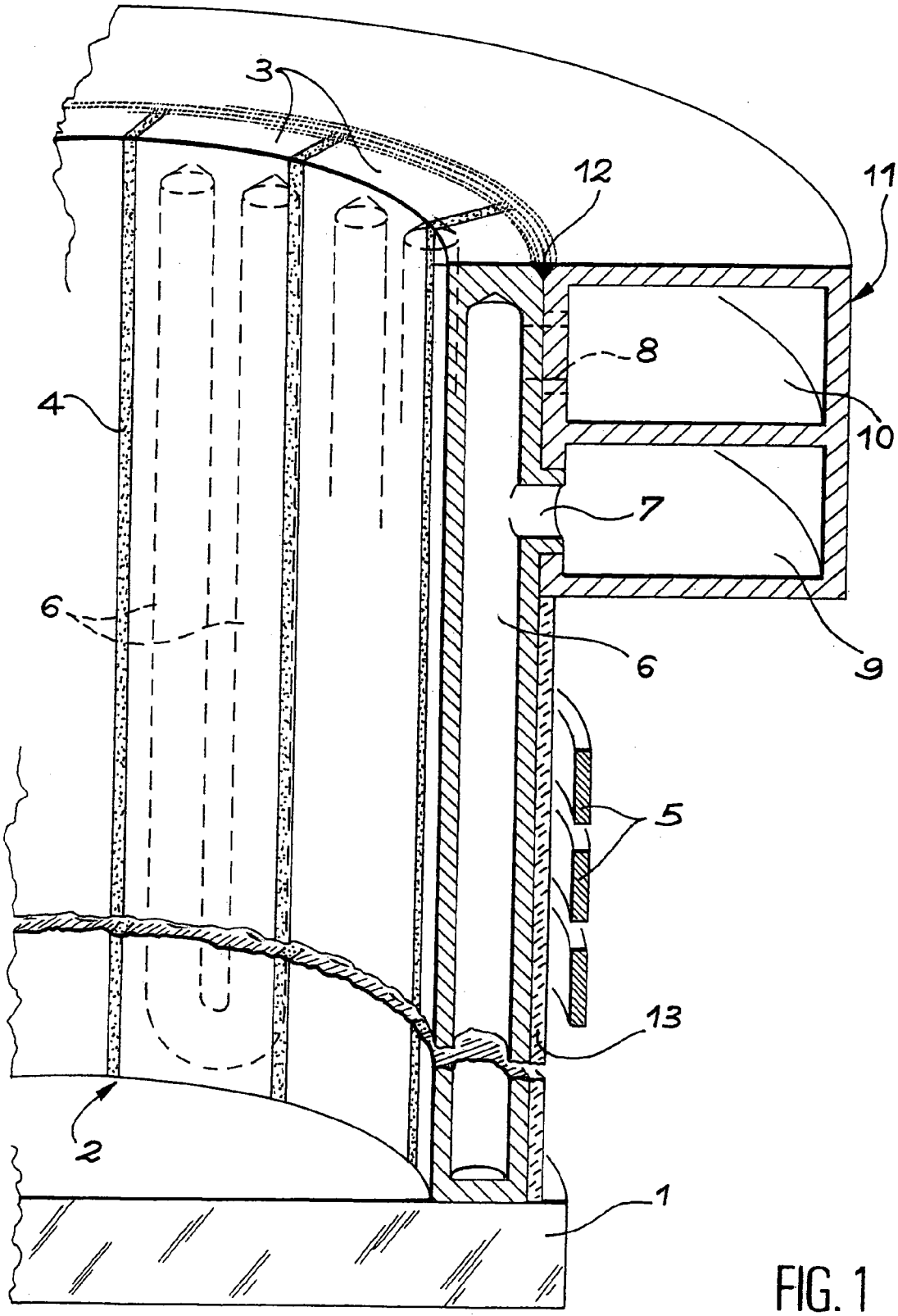
FIG. 1 shows a welded crucible according to the prior art.

With reference to FIG. 1, a crucible comprises a hearth in refractory concrete which carries reference 1, a side wall carrying reference 2, its segments in stainless steel carrying reference 3, intermediate layers of electric insulation reference 4, and inductor coils reference 5. The details of construction and arrangement of these parts comply with the aforesaid description. Side part 2 is only partly shown, but it is clear that it extends over a circle or complete turn as for any other crucible including those of the invention. A cooling circuit 6 is hollowed out of each of segments 3, which extends over practically their entire height and is here made up of a pair of parallel ducts meeting at the bottom of segments 3 (only one of these ducts being visible in the cross-section). By means of pierced inlets and outlets 7 and 8 for the cooling liquid, the ducts communicate outside of segments 3 and lead to superimposed collectors 9 and 10 belonging to the same flange 11 to which segments 3 are welded by a circular bead 12 on their top outer edge. Even with this welding, it is possible to add to the structure an outer banding 13 under flange 11 to improve the cohesion of the side wall 2 and to ensure a gas seal. The disadvantages mentioned above concerning the two assembly modes for the side wall 2 are not eliminated even if these modes are combined. Hearth 1 is cooled by the circulation of water in the metallic boxes which have not been shown in this figure.

Figure 2:
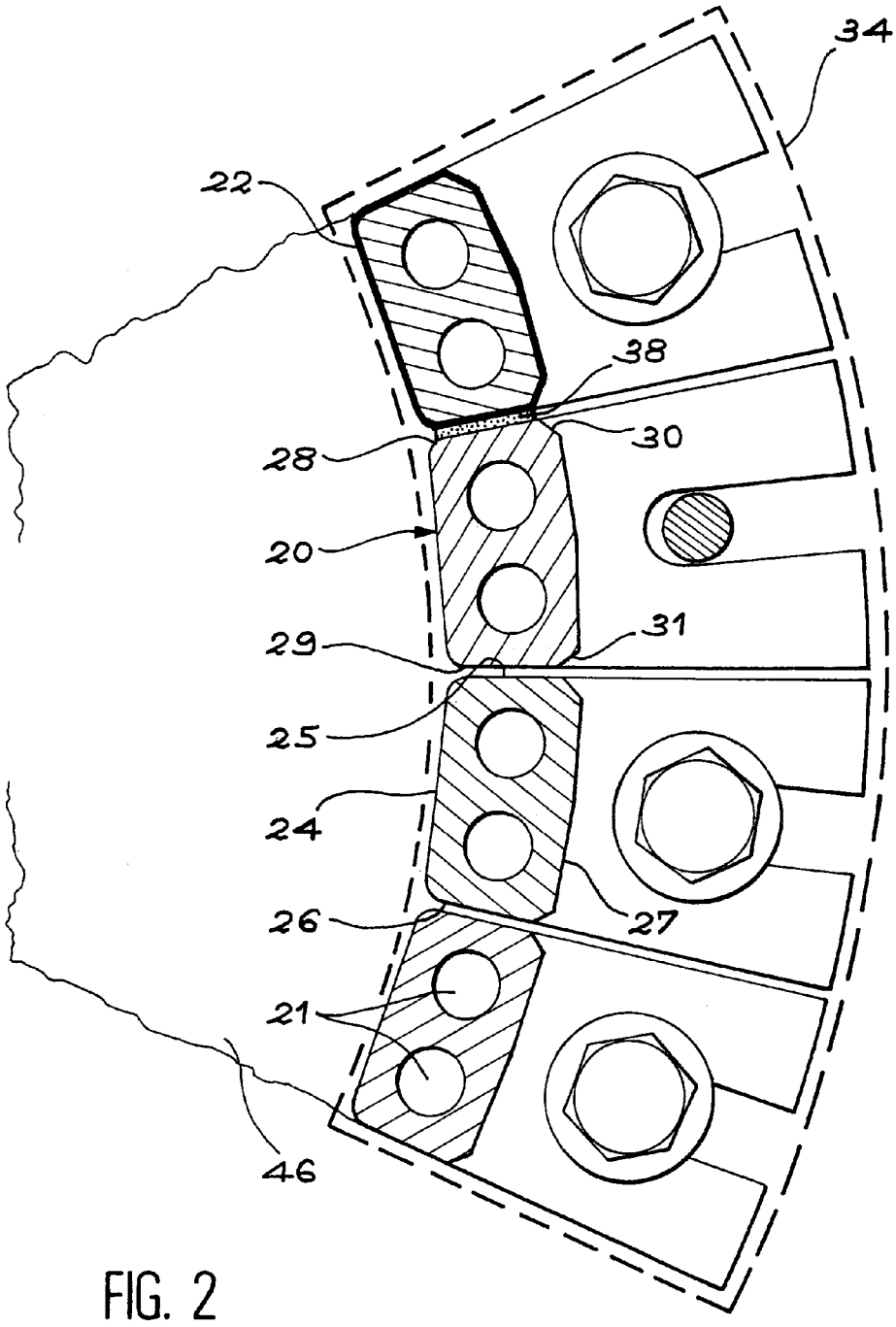
FIGS. 2 and 3 illustrate an embodiment of a crucible of the invention.

An embodiment of the invention will now be described with the help of FIGS. 2 and 3.

The segments of the side wall carry reference 20. They have the same outer shape and similarly have a pair of ducts passing through them as a cooling circuit 21 whose ends lead to the outside via tubes 23*a* and 23*b* (FIG. 3). But contrary to the prior art, segments 20 of the invention are not bare but are coated with a ceramic coating 22 which may be chosen from among compositions containing alumina, mullite, cordierite, zircon, zirconia or zirconates, different additives optionally being added in relation to the thermal, chemical and electric stresses which the crucible may have to undergo. A single segment 20 is shown with coating 22 in FIG. 2, but all the segments are coated. Similarly coating 22 is present on segment 20 in FIG. 3 but has not been shown for reasons of clarity. It is recommended to coat at least the inner face 24 of segments 20 and their side faces 25 and 26, which are the faces subjected to corrosion and the onset of electric arcs; however, it would also be expedient to coat the outer face 27, as shown here, or even the top and bottom faces. Since chemical attack or risks of electric short circuits which could warrant the use of coating 22 would derive from the gases staying above the molten matter and from the particles and releases carried by these gases rather than from the molten matter itself, one of the functions of these cold crucibles being to maintain a solid thickness of the crucible content on the side wall, coating 22 extends as far as the top of segments 20. Its thickness lies between 50 $\mu$m and 500 $\mu$m depending upon applications. One additional arrangement to reduce the probability of electric arcs while allowing better adherence of coating 22, is to eliminate the sharp edges between faces 24 to 27 of segments 20: here the sharp edges 28 and 29 on the inside of the furnace (between the inner face 24 and side faces 25 and 26) have been rounded to a radius of curvature of possibly one to five millimetres, and the other sharp edges such as 30 and 31 (between the outer face 27 and the other side faces 25 and 26) have simply been chamfered; this latter arrangement is only necessary to facilitate the adherence of coating 22 to the junction of the two coated faces. The horizontal sharp edges of segments 20, at the top and bottom, may also be rounded or chamfered if electric arcs are a risk with neighbouring elements.

Figure 3:
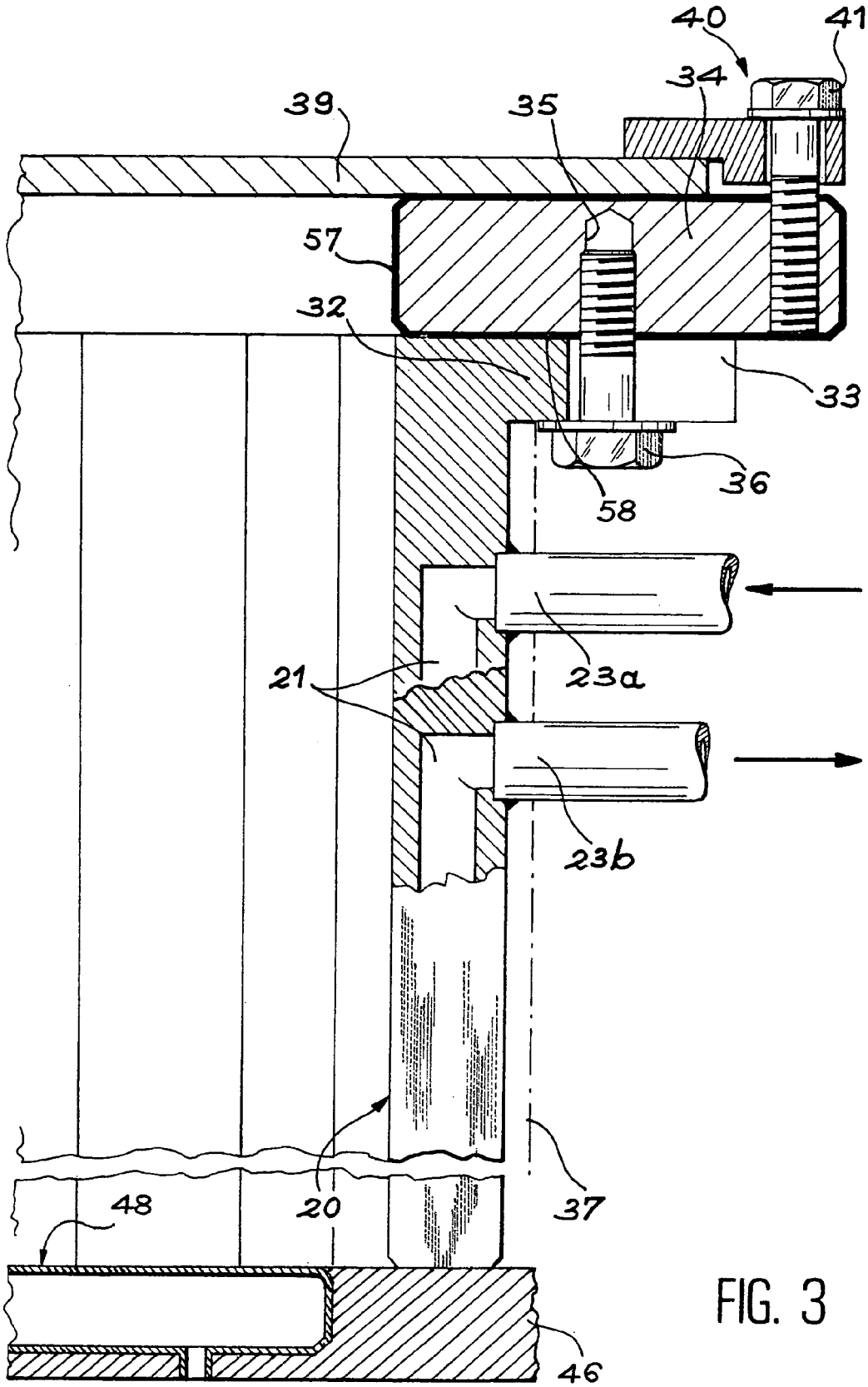

With special reference to FIG. 3, it can be seen that flange 11 has disappeared and that the cooling circuits 21 are not associated with collectors such as 9 and 10 adjacent to the crucible but are completely separate, tubes 23*a* and 23*b* extending to the outside. Segments 20 comprise an upper lug 32 also in a sector of circle which overhangs the outer face 27. It comprises a cut-out 33 opening onto the outside. A flat flange 34 of circular shape is laid on all lugs 32 and comprises tapped holes 35. Screws 36 are engaged in tapped holes 35 through cut-outs 33 and lean against the underside of lugs 32 holding them against the flat flange 34. Therefore the segments 20 are held in position and form a single assembly. An outer banding 37 may be added to ensure an air seal for the crucible and render the assembly more solid but is not indispensable; it may be in solid glass fabric impregnated with elastomer or epoxy resin. Finally, layers of electric insulation 38 in mica for example may be inserted between the side faces 25 and 26 of neighbouring segments 20.

A ceramic coating 57 may also be deposited on flange 34, and above all on its lower face 58 touching lugs 32 of segments 20. Here again it is expedient to chamfer the sharp edges joining two faces coated with ceramic.

Another arrangement, made possible through flat flange 34, consists of adding a cover 39 laid on the flange and held by two clamps 40 with screws 41 engaged in tapped holes of the flat flange 34 so as to confine the content of the crucible and ensure a perfect seal.

Figure 4:
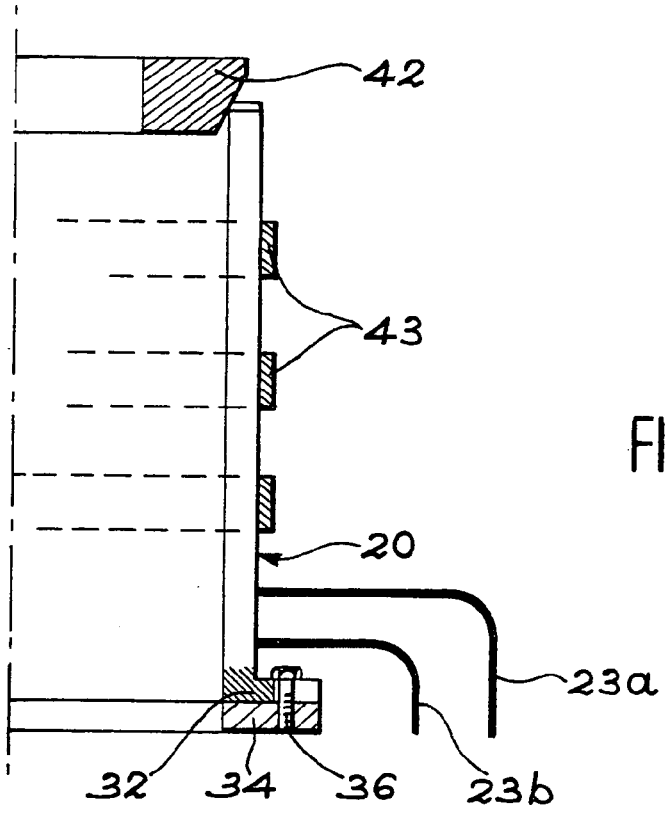
FIGS. 4 and 5 illustrate the mode of fabrication of the crucible.
Figure 5:
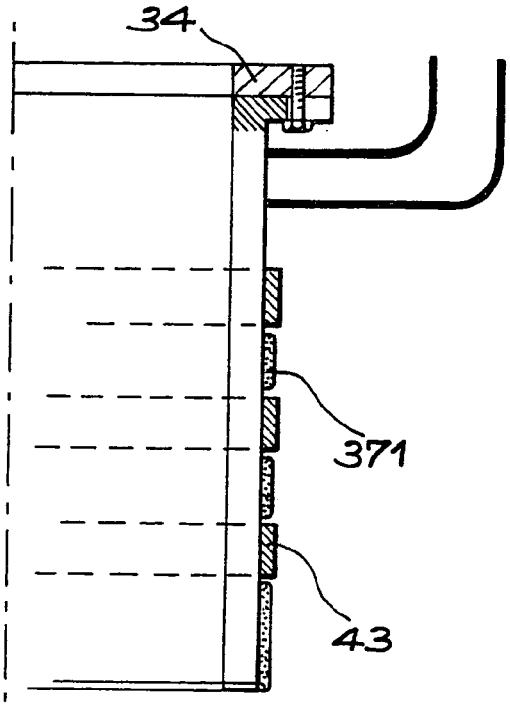

It has already been mentioned that with the precise, invariable adjustment of segments 20 made possible through an assembly using screws and a flat flange 34, the segments 20 can be coated with ceramic without any risk for the ceramic. A method for assembling the side wall will now be described with which it is possible not to expose the ceramic to damage even with this configuration; this description will be given with reference to FIGS. 4 and 5. Segments 20, after being sufficiently precision machined at the required points (in particular at the lower face, laid on concrete hearth 1, at the upper face of lugs 32 and at side faces 25 and 26) and coated with ceramic by plasma deposit and abrasive polishing, are roughly positioned on the flat flange after being turned around, a conical centring wedge 42 is placed on them and clamp collars 43 are inserted around them and tightened to bring them into contact with the entire conical flank of wedge 42. The layers of electric insulation 38 have already been inserted. Depending upon the height of wedge 42 and the clamping of collars 43 the diameter of the side wall and its preload can be adjusted. Screws 36 are then tightened to contact lugs 32 with underlying flat flange 34. The assembly is then complete. Banding 37 may be formed firstly by wrapping 371 placed between the clamp collars 43, then by additional wrapping when the clamp collars 43 have been removed. This two-step laying of the banding makes it possible not to release the preloading of the side wall through premature unlocking of collars 43.

Figure 6:
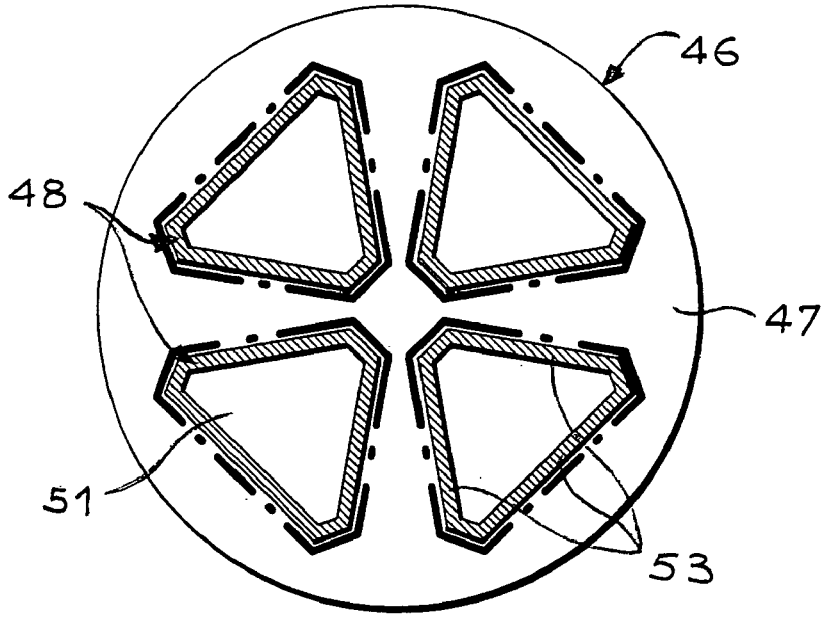
FIGS. 6 and 7 illustrate a hearth of the invention.
Figure 7:
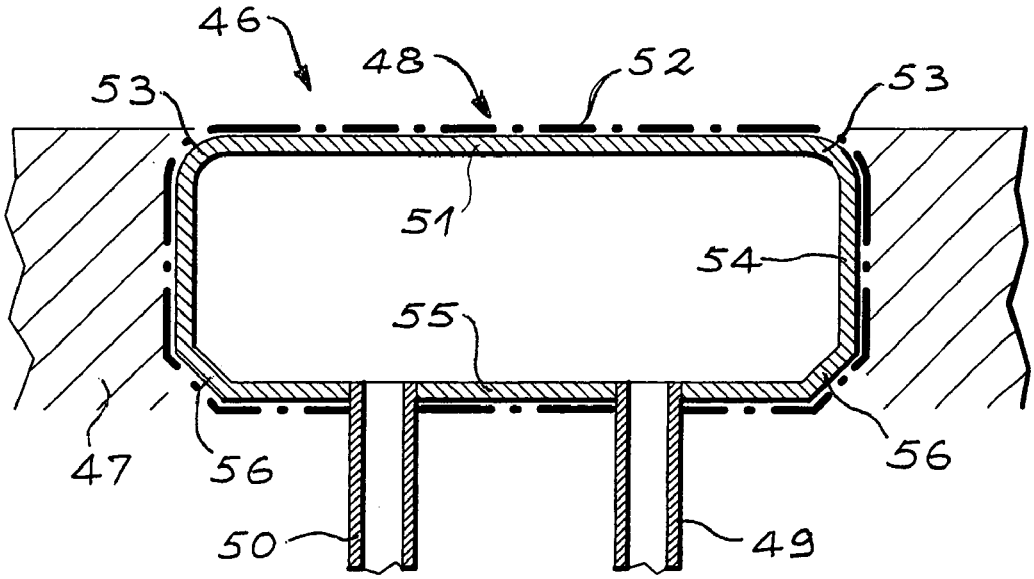

FIGS. 6 and 7 illustrate the hearth 46 of the embodiment of the invention. It comprises a main plate 47 provided with a central concavity occupied by the cooling boxes 48. Each box 48 comprises a water inlet duct 49 and outlet duct 50.

Similarly to segments 20 of the crucible, it is sought to protect boxes 48 against chemical and thermal attack and to provide against opposing electric arcs occurring between them. They are also coated with ceramic, at least on their upper face (facing the molten bath) 51; the coating carries reference 52. And the sharp edges 53 delimiting this upper face 51 are rounded, also to a radius of curvature of one to five millimetres; the other sharp edges 56 (vertical and delimiting the lower face 55) may also be rounded or at least chamfered, especially if the side faces 54 and lower faces 55 which they delimit are also coated with ceramic.

What is claimed is:

1. An induction furnace comprising:

a side wall comprising vertical side-by-side segments, wherein the segments are coated with ceramic at least on inner faces and side faces, and at least sharp edges joining said inner faces to said side faces are rounded.

2. An induction furnace as in claim 1, further comprising a hearth on which the side wall is positioned, wherein the hearth is provided with cooling boxes coated with ceramic at least on upper faces, and at least sharp edges delimiting said upper faces are rounded.

3. An induction furnace as in claim 1, wherein the segments are further coated with ceramic on outer faces.

4. An induction furnace as in claim 2, wherein the cooling boxes are further coated with ceramic on lower faces and side faces.

5. An induction furnace as in claim 1, wherein the segments comprise lugs for assembly with an upper flange, and the upper flange is coated with ceramic at least on one face touching the segments.

6. An induction furnace as in claim 2, wherein the faces of the segments and cooling boxes that are coated with ceramic are joined together by rounded or chamfered edges.

7. An induction furnace as in claim 1, wherein the ceramic is chosen from among mullite, alumina, cordierite, zircon, zirconia, and zirconate.

* * * * *